US009238926B2

(12) United States Patent
Guerrero et al.

(10) Patent No.: US 9,238,926 B2
(45) Date of Patent: Jan. 19, 2016

(54) KEYLESS LOCK ASSEMBLY

(71) Applicants: Abel Guerrero, La Puente, CA (US); Rosa Guerrero, La Puente, CA (US)

(72) Inventors: Abel Guerrero, La Puente, CA (US); Rosa Guerrero, La Puente, CA (US)

( * ) Notice: Subject to any disclaimer, the term of this patent is extended or adjusted under 35 U.S.C. 154(b) by 279 days.

(21) Appl. No.: 13/953,811

(22) Filed: Jul. 30, 2013

(65) Prior Publication Data

US 2015/0035289 A1 Feb. 5, 2015

(51) Int. Cl.

| | |
|---|---|
| ***E05C 5/00*** | (2006.01) |
| ***E05B 15/10*** | (2006.01) |
| ***E05B 17/20*** | (2006.01) |
| ***E05B 63/12*** | (2006.01) |
| ***E05B 67/38*** | (2006.01) |
| ***E05C 1/04*** | (2006.01) |

(52) U.S. Cl.

CPC ..... *E05B 15/101* (2013.01); *E05B 17/2076* (2013.01); *E05B 63/125* (2013.01); *E05B 67/383* (2013.01); *E05C 1/04* (2013.01); *Y10T 292/0887* (2015.04)

(58) Field of Classification Search

CPC ..... Y10S 292/15; E05C 17/446; E05C 17/54; Y10T 292/65; Y10T 16/61; Y10T 292/558; Y10T 292/19

USPC ..... 292/64, DIG. 15

See application file for complete search history.

(56) References Cited

U.S. PATENT DOCUMENTS

| | | | | | |
|---|---|---|---|---|---|
| 1,448,298 | A * | 3/1923 | Hight | 16/83 |
| 1,598,506 | A | 8/1926 | Riddle | |
| 1,808,393 | A * | 6/1931 | Wecker | 292/338 |
| 2,653,420 | A * | 9/1953 | Ruth | 451/38 |
| 3,024,056 | A * | 3/1962 | Cook | 292/177 |
| 3,174,314 | A * | 3/1965 | Grady | 70/77 |
| 3,582,122 | A * | 6/1971 | Foster et al. | 292/335 |
| 4,027,508 | A | 6/1977 | McGourty | |
| 4,089,083 | A * | 5/1978 | Wilde et al. | 16/82 |
| 4,456,291 | A * | 6/1984 | Brogie | 292/338 |
| 4,799,371 | A | 1/1989 | Duncan | |
| 5,120,093 | A * | 6/1992 | Carney | 292/60 |
| 6,575,004 | B2 | 6/2003 | Berton et al. | |
| 6,782,724 | B2 * | 8/2004 | Kelly | 70/100 |
| 7,316,139 | B2 | 1/2008 | Nakazima et al. | |
| 7,788,954 | B2 * | 9/2010 | Schumm | 70/107 |
| 8,250,811 | B2 * | 8/2012 | Zijlstra | 49/394 |
| 8,556,306 | B1 * | 10/2013 | Lin | 292/166 |
| 2008/0115546 | A1 | 5/2008 | Hu | |

* cited by examiner

*Primary Examiner* — Mark Williams

(57) ABSTRACT

A keyless lock assembly for selectively locking and unlocking a door includes a plate that is coupled to a door. A guide is coupled to the plate. A tubular housing is coupled to the plate. A shaft is operationally coupled to the tubular housing. A locking pin is coupled to the shaft and is positioned within a pin groove. A rotation slot extends into the tubular housing. The rotation slot is in communication with the pin groove. A locking slot extends into the tubular housing. The locking slot is in communication with the rotation slot so the locking slot retains the locking pin. A handle is coupled to the shaft. A locking bracket is coupled to the door. The handle engages the locking bracket. A shaft cup extends into a support surface proximate the door so the shaft cup receives the shaft so the door is locked.

16 Claims, 4 Drawing Sheets

104
102
108
100
106
110

KEYLESS LOCK ASSEMBLY

BACKGROUND OF THE DISCLOSURE

Field of the Disclosure

The disclosure relates to keyless lock devices and more particularly pertains to a new keyless lock device for selectively locking and unlocking a door.

SUMMARY OF THE DISCLOSURE

An embodiment of the disclosure meets the needs presented above by generally comprising a plate that is coupled to a door. A guide is coupled to the plate. A tubular housing is coupled to the plate. A shaft is operationally coupled to the tubular housing so the shaft extends through the guide and the tubular housing. A locking pin is coupled to the shaft so the locking pin is positioned within a pin groove in the tubular housing. A rotation slot extends into the tubular housing. The rotation slot is in communication with the pin groove so the rotation slot receives the locking pin while the shaft is moved into a locking position. A locking slot extends into the tubular housing. The locking slot is in communication with the rotation slot so the locking slot retains the locking pin after the shaft is positioned in the locking position. A handle is coupled to the shaft. A locking bracket is coupled to the door. The handle engages the locking bracket when the shaft is moved into the locking position. A shaft cup extends into a support surface proximate the door so the shaft cup receives the shaft when the shaft is positioned in the locking position so the door is locked.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other then those set forth above will become apparent when consideration is given to the following detailed description thereof. Such description makes reference to the annexed drawings wherein.

DESCRIPTION OF THE PREFERRED EMBODIMENT

Figure 1:
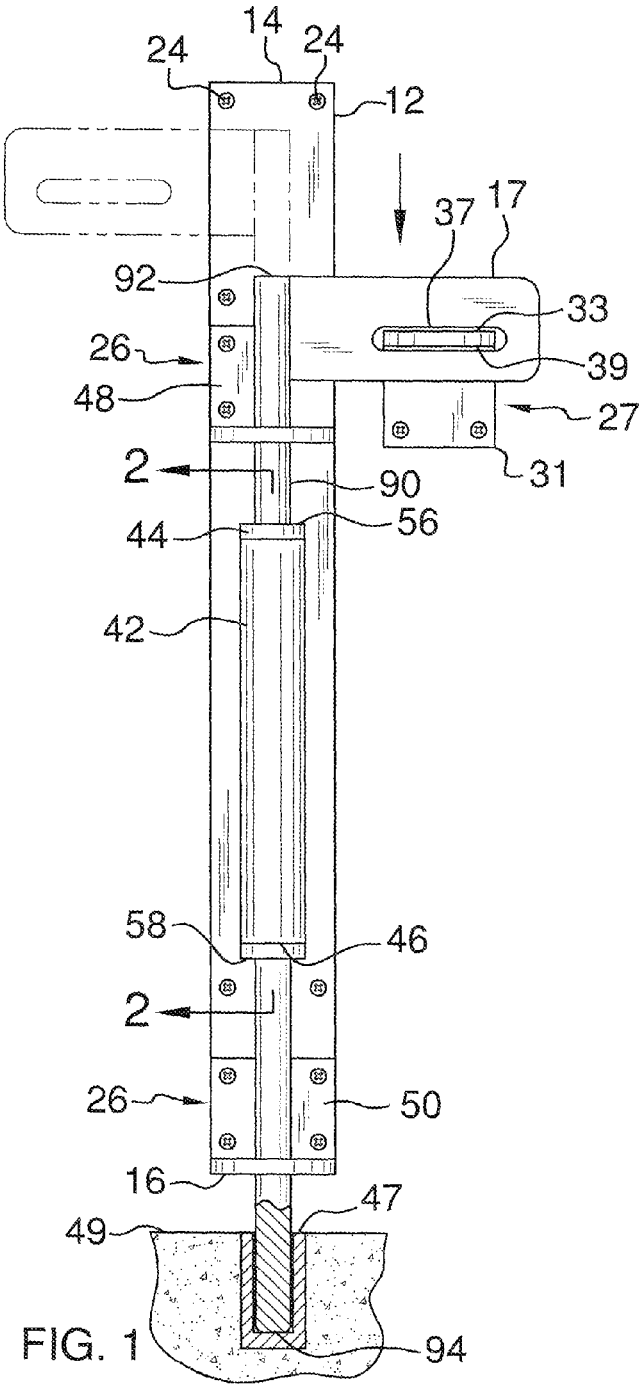
FIG. 1 is a front view of a keyless lock assembly according to an embodiment of the disclosure.
Figure 2:
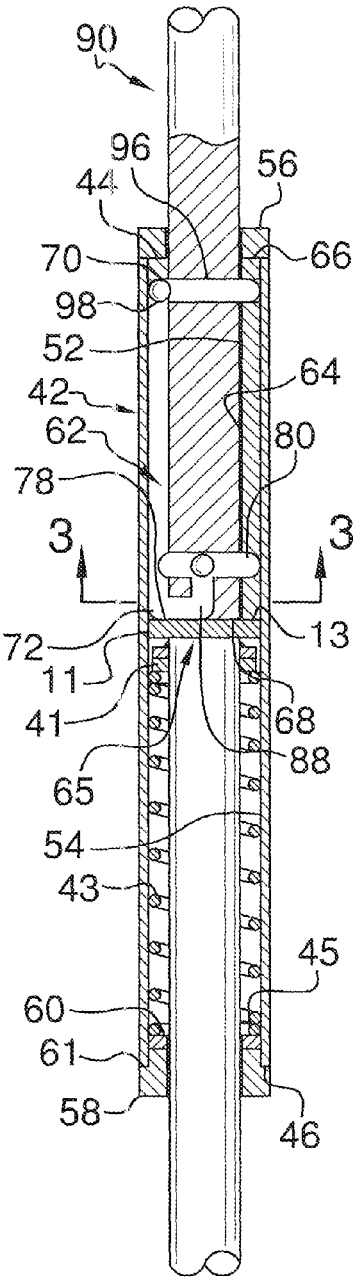
FIG. 2 is a cross sectional view taken along line 2-2 of FIG. 1 of an embodiment of the disclosure.
Figure 3:
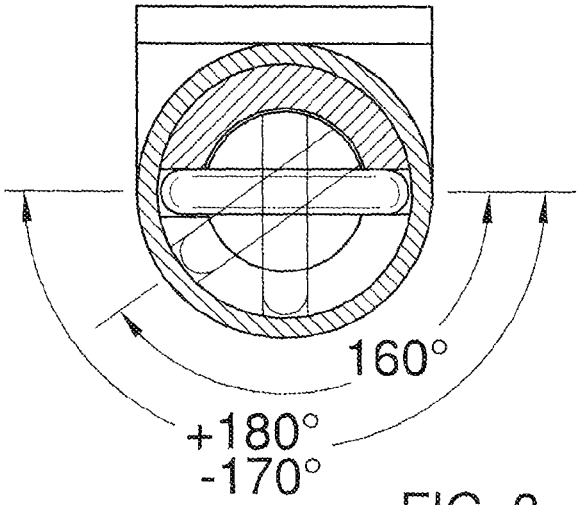
FIG. 3 is a cross sectional view taken along line 3-3 of FIG. 2 of an embodiment of the disclosure.
Figure 4:
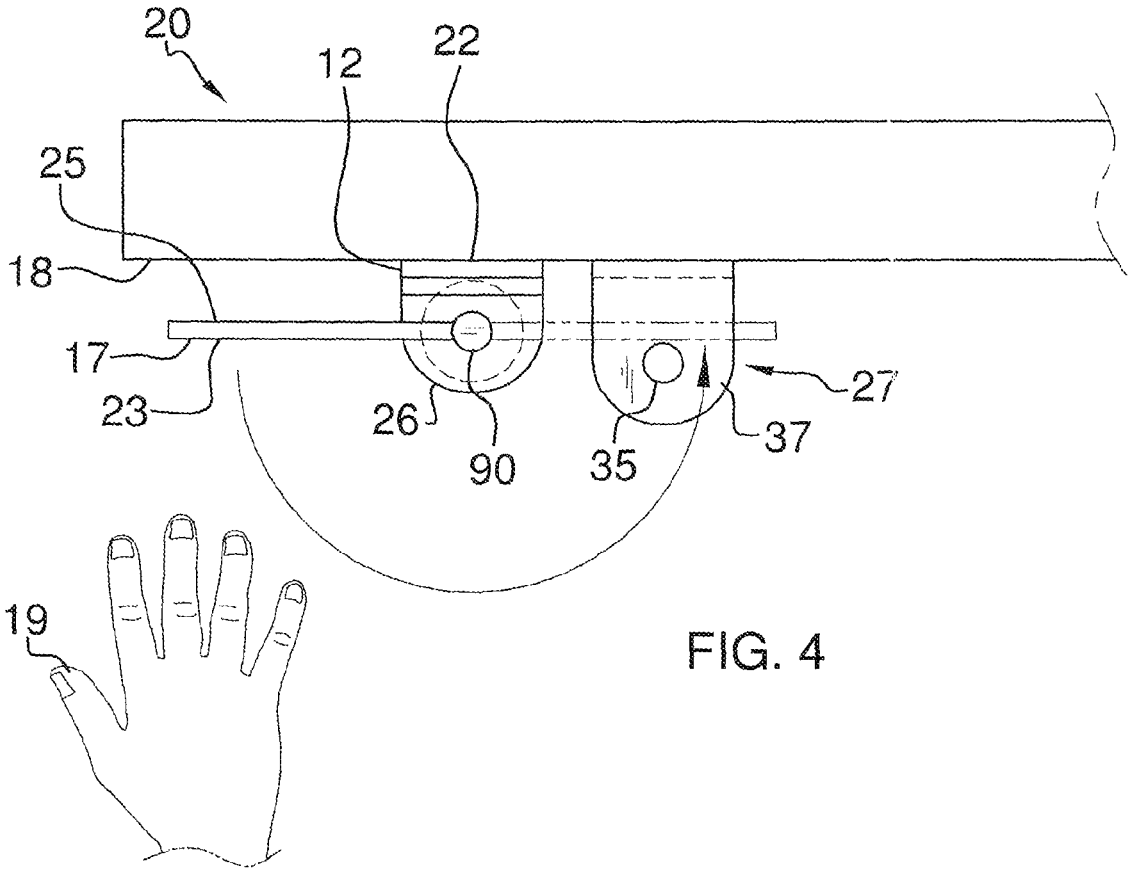
FIG. 4 is a cross sectional view taken along line 4-4 of FIG. 3 of an embodiment of the disclosure.
Figure 5:
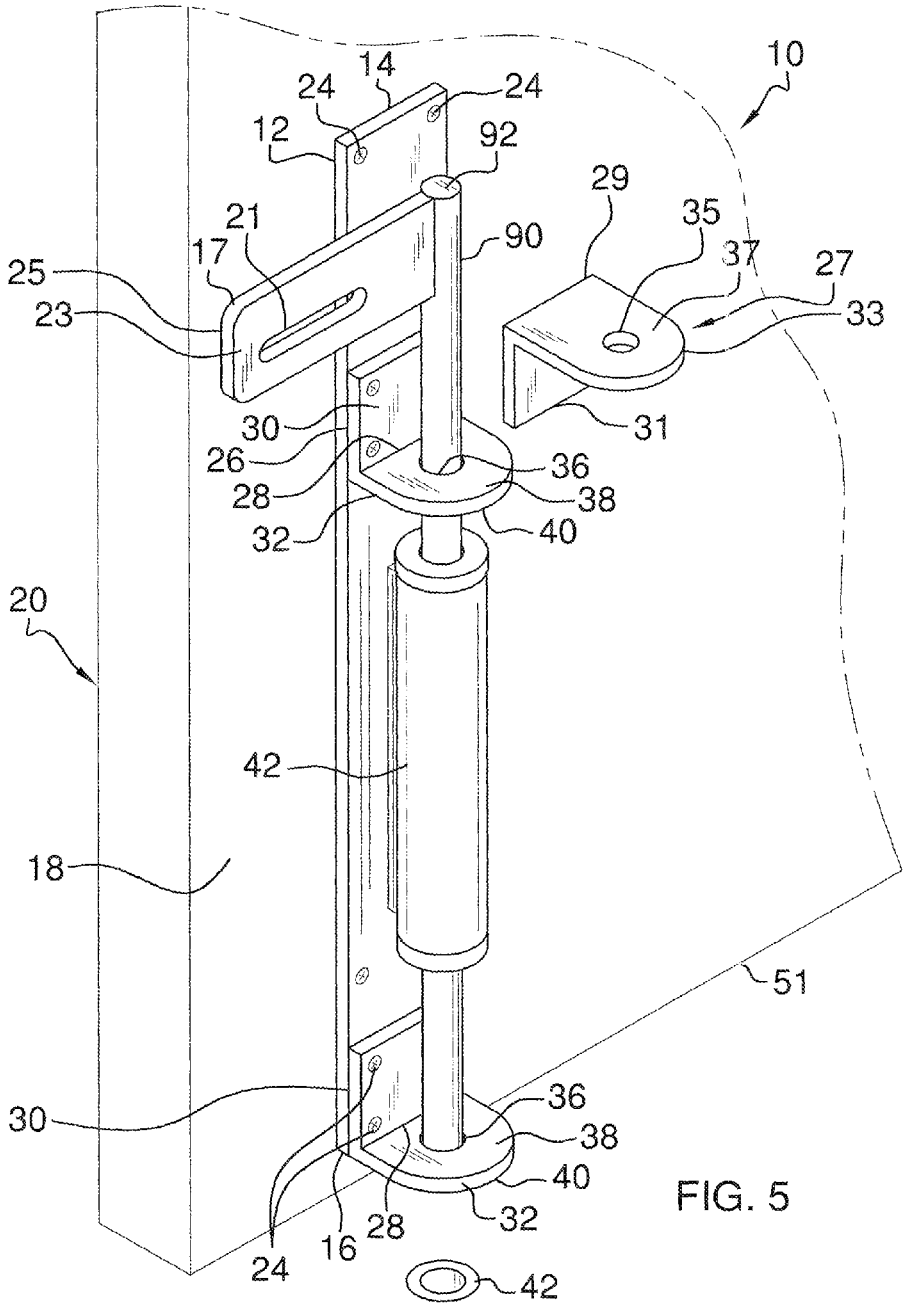
FIG. 5 is a top view of an embodiment of the disclosure.

With reference now to the drawings, and in particular to FIGS. 1 through 6 thereof, a new keyless lock device embodying the principles and concepts of an embodiment of the disclosure and generally designated by the reference numeral 10 will be described.

As best illustrated in FIGS. 1 through 6, the keyless lock assembly 10 generally comprises a plate 12 is that is elongated along a longitudinal axis extending through a top end 14 and a bottom end 16 of the plate 12. The plate 12 is coupled to a front side 18 of a door 20 so a back side 22 of the plate 12 abuts the front side 18 of the door 20. Additionally, the plate 12 may have a length between 12 cm and 18 cm and a width between 2.5 cm and 5 cm. A plurality of fasteners 24 extends through the plate 12 and engages the front side 18 of the door 20 so the plate 12 is retained on the door 20.

A guide 26 is provided that includes a centrally positioned bend 28 so a mounting portion 30 of the guide 26 forms a right angle with respect to a shaft portion 32 of the guide 26. The mounting portion 30 of the guide 26 is coupled to a front side 34 of the plate 12 so the shaft portion 32 of the guide 26 is directed forwardly from the plate 12. A plurality of the fasteners 24 extends through the mounting portion 30 of the guide 26 and engages the front side 34 of the plate 12 so the guide 26 is retained on the plate 12. Additionally, a shaft aperture 36 extends through a top side 38 and a bottom side 40 of the shaft portion 32 of the guide 26. Moreover, the guide 26 is one of a pair of guides 26 each positioned proximate an associated one of the top 14 and bottom 16 ends of the plate 12.

A tubular housing 42 is elongated along a longitudinal axis extending through an open top end 44 and an open bottom end 46 of the tubular housing 42. The tubular housing 42 is coupled to the front side 34 of the plate 12 so the tubular housing 42 extends between a top one 48 and a bottom one 50 of the pair of guides 26. Further, the tubular housing 42 may be welded to the plate 12 so the tubular housing 42 is permanently retained on the plate 12. An upper portion 52 of the tubular housing 42 has an inside diameter that is less than an inside diameter of a lower portion 54 of the tubular housing 42. Lastly, the tubular housing 42 may have a length between 7 cm and 13 cm.

A top end cap 56 is coupled to the open top end 44 of the tubular housing 42. The top end cap 56 is ring shaped to allow access into an interior of the tubular housing 42. A bottom end cap 58 is coupled to the open bottom end 46 of the tubular housing 42. The bottom end cap 58 is ring shaped to allow access into an interior of the tubular housing 42. Further, an insertion portion 60 of the bottom end cap 58 is coupled to and extends upwardly from a top surface 61 of the bottom end cap 58. The insertion portion 60 of the bottom end cap 58 has an outside diameter that is less than an outside diameter of the bottom end cap 58 so the insertion portion 60 of the bottom end cap 58 is positioned within the lower portion 54 of the tubular housing 42.

A pin groove 62 extends into an inside surface 64 of the upper portion 52 of the tubular housing 42. The pin groove 62 extends between a top end 66 and a bottom end 68 of the upper portion 52 of the tubular housing 42. Additionally, the pin groove 62 may have a width and a depth between 3 mm and 6 mm. A top end 70 of the pin groove 62 is spaced downwardly from the top end 66 of the upper portion 52 of the tubular housing 42.

A rotation slot 72 extends upwardly into and is coextensive with a bottom edge 74 of the upper portion 52 of the tubular housing 42. A first end 76 of the rotation slot 72 intersects with a bottom end 78 of the pin groove 62 so the rotation sot 72 is in fluid communication with the pin groove 62. Continuing, the rotation slot 72 may extend around the bottom edge 74 of the upper portion 52 of the tubular housing 42 between a range of 150 degrees and 160 degrees with respect to the bottom end 78 of the pin groove 62. Lastly, the rotation slot 72 may have a width and a depth between 3 mm and 6 mm.

A locking slot 80 extends into the inside surface 64 of the upper portion 52 of the tubular housing 42 so the locking slot 80 is coextensive with the bottom edge 74 of the upper portion 52 of the tubular housing 42. The locking slot 80 is positioned upwardly from the bottom edge 74 of the upper portion 52 of the tubular housing 42. Moreover, a first end 82 of the locking slot 80 is positioned above and aligned with a second end 84 of the rotation slot 72. The locking slot 80 may extend around the inside surface 64 of the upper portion 52 of the tubular housing 42 between a range of 15 degrees and 20 degrees. Continuing, a second end 86 of the locking slot 80 is positioned away from the bottom end 78 of the pin groove 62 between a range of 175 degrees and 180 degrees. Lastly, the locking slot 80 may have a width and a depth between 3 mm and 6 mm.

A transition groove 88 extends into the inside surface 64 of the upper portion 52 of the tubular housing 42. Moreover, the transition groove 88 extends upwardly between the second end 84 of the rotation slot 72 and the first end 82 of the locking slot 80. The transition groove 88 places the rotation slot 72 in fluid communication with the locking slot 80. Finally, the transition groove 88 may have a width and a depth between 3 mm and 6 mm.

A shaft 90 is movably coupled to the tubular housing 42 so the shaft 90 extends through the shaft aperture 36 in each of the top 48 and bottom 50 guides as well as each of the top 56 and bottom 58 end caps. A top end 92 of the shaft 90 positioned above the top guide 48 and a bottom end 94 of the shaft 90 is positioned below the bottom guide 50. The shaft 90 may have a length between 14 cm and 20 cm. Continuing, a locking pin 96 is coupled to the shaft 90 so a rounded end 98 of the locking pin 96 extends away from the shaft 90. The rounded end 98 of the locking pin 96 slidably engages the pin groove 62. Lastly, the locking pin 96 may have a diameter between 2.5 mm and 5.5 mm.

A primary washer 11 is coupled to the bottom edge 74 of the upper portion 52 of the tubular housing 42 so the shaft 90 extends through the primary washer 11. The shaft 90 is positionable in a locking position where the shaft 90 is urged downwardly. The rounded end 98 of the locking pin 96 travels downwardly in the pin groove 62 until the rounded end 98 of the locking pin 96 abuts a top 13 of the primary washer 11. The primary washer 11 prevents the locking pin 96 from exiting the upper portion 52 of the tubular housing 42.

The shaft 90 is rotated such that the rounded end 98 of the locking pin 96 travels laterally along the rotation slot 72 until the rounded end 98 of the locking pin 96 abuts the second end 84 of the rotation slot 72. Continuing, the shaft 90 is lifted upwardly so the rounded end 98 of the locking pin 96 travels upwardly in the transition groove 88 until the rounded end 98 of the locking pin 96 is positioned in the first end 82 of the locking slot 80. Moreover, the shaft 90 is further rotated such that the rounded end 98 of the locking pin 96 travels laterally along the locking slot 80 until the rounded end 98 of the locking pin 96 abuts a second end 15 of the locking slot 80. The locking slot 80 retains the shaft 90 in the locking position. The rotation slot72, the transition groove 88 and the locking slot 80 allows the shaft 90 to be moved between the locking position and an unlocked position without the use of a key.

A handle 17 is coupled to the shaft 90 proximate the top end 92 of the shaft 90 so the handle 17 may be gripped by a user 19. The user 19 grips the handle 17 to manipulate the shaft 90 between the locking and the unlocked positions. The handle 17 may have a length between 5 cm and 8 cm. Lastly, a locking bracket slot 21 extends through a front side 23 and a back side 25 of the handle 17.

A locking bracket 27 includes a centrally positioned bend 29 so a mounting portion 31 of the locking bracket 27 forms a right angle with respect to a lock portion 33 of the locking bracket 27. The mounting portion 31 of the locking bracket 27 is coupled to the front side 18 of the door 20 proximate the top end 92 of the shaft 90 so the lock portion 33 of the locking bracket 27 is directed forwardly from the front side 18 of the door 20. A plurality of the fasteners 24 extends through the mounting portion 31 of the locking bracket 27 so the locking bracket 27 is retained on the door 20. Continuing, the handle 17 engages the locking bracket 27 when the shaft 90 is moved into the locking position so the lock portion 33 of the locking bracket 27 extends through the locking bracket slot 21.

A lock aperture 35 extends through a top side 37 and a bottom side 39 of the lock portion 33 of the locking bracket 27. After the shaft 90 is positioned in the locking position an object may be extended through the lock aperture 35. The object may be used to retain the handle 17 on the lock portion 33 of the locking bracket 27. Moreover, the object may be a padlock or other similar object to provide an additional level of security for the door 20.

A secondary washer 41 is coupled to the shaft 90 proximate middle 65 of the shaft 90 so the secondary washer 41 is positioned within the lower portion 54 of the tubular housing 42. When the shaft 90 is positioned in the unlocked position the secondary washer 41 abuts the primary washer 11. Continuing, the secondary washer 41 has an outside diameter that is less than an inside diameter of the lower portion 54 of the tubular housing 52. Lastly, the secondary washer 41 may be comprised of a rigid material such as brass or other similar material.

A biasing member 43 is positioned within the lower portion 54 of the tubular housing 52 so the shaft 90 extends through the biasing member 43. The biasing member 43 urges the shaft 90 upwardly into an unlocked position. Finally, the biasing member 43 may be a spring biasing member of any conventional design. A biasing member retainer 45 is positioned in the lower portion 54 of the tubular housing 52. The biasing member retainer 45 abuts the insertion, portion 60 of the bottom end cap 58 so the shaft 90 extends through the biasing member retainer 45. Lastly, the biasing member retainer 45 may be comprised of a rigid material such as brass or other similar material.

A shaft cup 47 extends into downwardly a support surface 49. The support surface 49 may be a concrete floor or other similar support surface 49. The shaft cup 47 is positioned proximate a bottom 51 of the door 20 when the door 20 is in a closed position. The shaft cup 47 insertably receives the bottom end 94 of the shaft 90 when the shaft 90 is positioned in the locking position so the door 20 is locked in the closed position.

Figure 6:
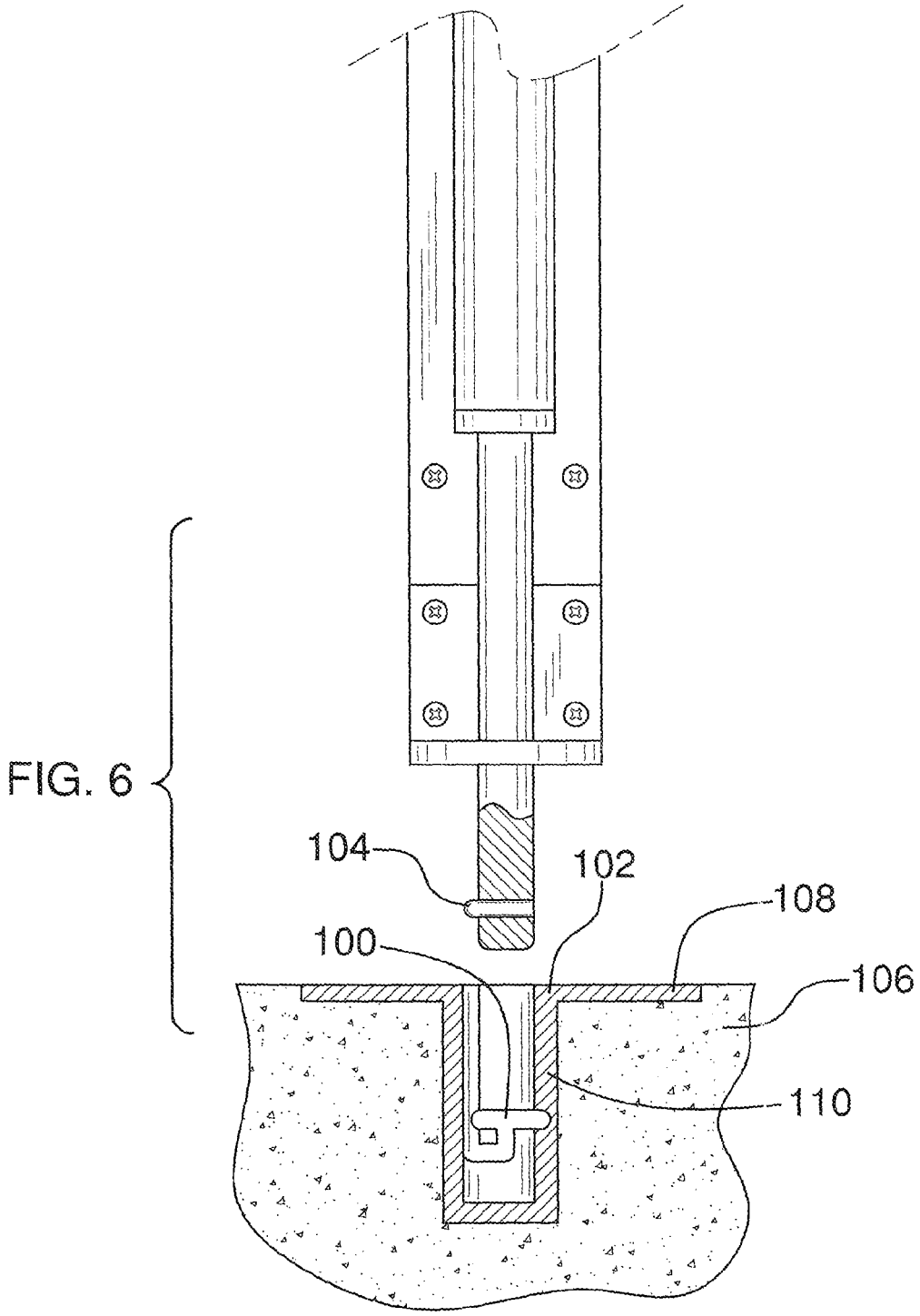
FIG. 6 is a perspective view of an embodiment of the disclosure.

In an embodiment shown in FIG. 6, a locking slot 100 may be positioned in a shaft cup 102 similar to shaft cup 47. A locking pin 104 similar to locking pin 90 may be extended into the shaft cup 102 such that the locking pin 104 engages the locking slot 100 in the same manner as locking pin 90 interacts with locking slot 80 as described above. Thus, except where mutually exclusive, the structural elements of embodiments shown in FIGS. 1 through 5 as described above, may be employed with the locking slot 100, shaft cup 102, and locking pin 104 to permit locking directly into a support surface 106 such as cement or the like. The shaft cup 102 may comprise a flange 108 extending outwardly from a main section 110 and embedded in the support surface 106 to facilitate securing the shaft cup 102 to the support surface 106 by conventional methods.

In use, the user 19 places the door 20 in the closed position. Continuing, the user 19 manipulates the handle 17 in order to place the shaft 90 in the locking position to lock the door 20 in the closed position. The relationship between the rotation slot 72 and the locking slot 80 may vary from one assembly 10 to another assembly 10 so that only the user 19 of the particular assembly 10 knows how to manipulate the shaft 90 between the locking and unlocking positions. The variation of relationships between the rotation slot 72 and the locking slot 80 prevents someone other than the user 19 horn being able to successfully manipulate the shaft 90 between the locking and unlocked positions. Moreover, the assembly 10 does not rely upon the placement of an object into the lock aperture 35 to retain the handle 17 on the lock portion 33 of the locking bracket 27. The user 19 may place an object into the lock aperture 35 to prevent someone other than the user 19 from attempting to manipulate the shaft 90 between the locking and unlocked positions.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A keyless lock assembly for selectively locking and unlocking a door, said assembly comprising:

a plate configured for being coupled to the door;

a guide coupled to said plate;

a tubular housing coupled to said plate;

a shaft operationally coupled to said tubular housing wherein said shaft extends through said guide and said tubular housing;

a locking pin coupled to said shaft, said locking pin being positioned within a pin groove in said tubular housing such that said locking pin is movable in said pin groove as said shaft is moved to extend said shaft from said tubular housing towards a locking position;

a rotation slot in said tubular housing, said rotation slot being in communication with said pin groove wherein said rotation slot receives said locking pin while said shaft is extended from said tubular housing and rotated towards said locking position;

a locking slot in said tubular housing, said locking slot being in communication with said rotation slot wherein said locking slot receives and retains said locking pin after said shaft is positioned in said locking position wherein said shaft is retained in said locking position;

a handle coupled to said shaft;

a locking bracket, said locking bracket being configured for being coupled to said door, said handle engaging said locking bracket when said shaft is moved into said locking position; and a shaft cup, said shaft cup being configured for extending into a support surface proximate the door wherein said shaft cup receives said shaft when said shaft is positioned in said locking position wherein the door is inhibited from being moved laterally relative to said shaft cup.

2. The assembly according to claim 1, further comprising:

said plate being elongated along a longitudinal axis extending through a top end and a bottom end of said plate; and said plate being coupled to a front side of the door wherein a back side of said plate abuts the front side of the door.

3. The assembly according to claim 1, further comprising said guide further comprising:

a centrally positioned bend on said guide wherein a mounting portion of said guide forms a right angle with respect to a shaft portion of said guide;

said mounting portion of said guide being coupled to a front side of said plate wherein said shaft portion of said guide is directed forwardly from said plate;

a shaft aperture extending through a top side and a bottom side of said shaft portion of said guide; and said guide being one of a pair of said guides each positioned proximate an associated one of a top end and a bottom end of said plate.

4. The assembly according to claim 1, further comprising:

said tubular housing being elongated along a longitudinal axis extending through an open top end and an open bottom end of said tubular housing;

said tubular housing being coupled to a front side of said plate wherein said tubular housing extends between a top one and a bottom one of a pair of said guides; and an upper portion of said tubular housing having an inside diameter being less than an inside diameter of a lower portion of said tubular housing.

5. The assembly according to claim 1, further comprising said pin groove extending into an inside surface of an upper portion of said tubular housing wherein said pin groove extends between a top end and a bottom end of said upper portion of said tubular housing.

6. The assembly according to claim 1, further comprising:

said rotation slot extending upwardly into and being coextensive with a bottom edge of an upper portion of said tubular housing wherein a first end of said rotation slot is aligned with a bottom end of said pin groove; and said rotation slot extending 160 degrees around said bottom edge of said upper portion of said tubular housing with respect to said bottom end of said pin groove.

7. The assembly according to claim 1, further comprising:

said locking slot extending into an inside surface of an upper portion of said tubular housing wherein said locking slot is coextensive with a bottom edge of said upper portion of said tubular housing;

said locking slot being positioned upwardly from said bottom edge of said upper portion of said tubular housing wherein a first end of said locking slot is aligned with a second end of said rotation slot;

said locking slot extending 20 degrees around said inside surface of said upper portion of said tubular housing wherein a second end of said locking slot is positioned 180 degrees away from a bottom end of said pin groove; and a transition groove extending into said inside surface of said upper portion of said tubular housing wherein said transition groove extends upwardly between said second end of said rotation slot and said first end of said locking slot.

8. The assembly according to claim 1, further comprising said shaft being rotatably coupled to said tubular housing wherein said shaft extends through a shaft aperture in each of a top one and a bottom one of a pair of said guides such that a top end of said shaft is positioned above said top guide and a bottom end of said shaft is positioned below said bottom guide.

9. The assembly according to claim 1, further comprising a rounded end of said locking pin extending away from said shaft wherein said rounded end of said locking pin slidably engages said pin groove.

10. The assembly according to claim 1, further comprising:

a primary washer coupled to a bottom edge of an upper portion of said tubular member wherein said shaft extends through said primary washer;

said shaft being positionable in said locking position wherein said shaft is urged downwardly such that a rounded end of said locking pin travels downwardly in said pin groove until said rounded end of said locking pin abuts a top of said primary washer;

said shaft being rotated such that said rounded end of said locking pin travels laterally along said rotation slot until said rounded end of said locking pin abuts a second end of said rotation slot;

said shaft being lifted upwardly wherein said rounded end of said locking pin travels upwardly in a transition groove until said rounded end of said locking pin is positioned in a first end of said locking slot; and said shaft being rotated such that said rounded end of said locking pin travels laterally along said locking slot until said rounded end of said locking pin abuts a second end of said locking slot wherein said shaft is retained in said locking position.

11. The assembly according to claim 1, further comprising:

said handle being coupled to said shaft proximate a top end of said shaft wherein said handle is configured to be gripped by a user; and a locking bracket slot extending through a front side and a back side of said handle.

12. The assembly according to claim 1, further comprising:

a centrally positioned bend on said locking bracket wherein a mounting portion of said locking bracket forms a right angle with respect to a lock portion of said locking bracket;

said mounting portion of said locking bracket being coupled to a front side of the door proximate a top end of said shaft wherein said lock portion of said locking bracket is directed forwardly from the front side of the door; and a lock aperture extending through a top side and a bottom side of said lock portion of said locking bracket.

13. The assembly according to claim 1, further comprising a secondary washer coupled to said shaft proximate a middle of said shaft.

14. The assembly according to claim 1, further comprising;

a biasing member positioned within an interior of said tubular housing wherein said shaft extends through said biasing member; and said biasing member urging said shaft upwardly between a locking position and an unlocked position.

15. The assembly according to claim 1, further comprising:

said shaft cup extending downwardly into the support surface wherein said shaft cup is positioned proximate a bottom of the door when the door is in a closed position; and said shaft cup insertably receiving a bottom end of said shaft.

16. A keyless lock assembly for selectively locking and unlocking a door, said assembly comprising:

a plate being elongated along a longitudinal axis extending through a top end and a bottom end of said plate, said plate being coupled to a front side of the door wherein a back side of said plate abuts the front side of the door;

a guide including a centrally positioned bend on said guide wherein a mounting portion of said guide forms a right angle with respect to a shaft portion of said guide, said mounting portion of said guide being coupled to a front side of said plate wherein said shaft portion of said guide is directed forwardly from said plate;

a shaft aperture extending through a top side and a bottom side of said shaft portion of said guide, said guide being one of a pair of said guides each positioned proximate an associated one of said top end and said bottom end of said plate;

a tubular housing being elongated along a longitudinal axis extending through an open top end and an open bottom end of said tubular housing, said tubular housing being coupled to said front side of said plate wherein said tubular housing extends between a top one and a bottom one of said pair of said guides, an upper portion of said tubular housing having an inside diameter being less than an inside diameter of a lower portion of said tubular housing;

a pin groove extends into an inside surface of said upper portion of said tubular housing wherein said pin groove extends between a top end and a bottom end of said upper portion of said tubular housing;

a rotation slot extending upwardly into and being coextensive with a bottom edge of said upper portion of said tubular housing wherein a first end of said rotation slot is aligned with a bottom end of said pin groove wherein said rotation slot is in communication with said pin groove, said rotation slot extending 160 degrees around said bottom edge of said upper portion of said tubular housing with respect to said bottom end of said pin groove;

a locking slot extending into said inside surface of said upper portion of said tubular housing wherein said locking slot is coextensive with said bottom edge of said upper portion of said tubular housing, said locking slot being positioned upwardly from said bottom edge of said upper portion of said tubular housing wherein a first end of said locking slot is aligned with a second end of said rotation slot, said locking slot extending 20 degrees around said inside surface of said upper portion of said tubular housing wherein a second end of said locking slot is positioned 180 degrees away from said bottom end of said pin groove;

a transition groove extending into said inside surface of said upper portion of said tubular housing wherein said transition groove extends upwardly between said second end of said rotation slot and said first end of said locking slot;

a shaft movably coupled to said tubular housing wherein said shaft extends through said shaft aperture in each of said top and said bottom guides such that a top end of said shaft is positioned above said top guide and a bottom end of said shaft is positioned below said bottom guide;

a locking pin coupled to said shaft wherein a rounded end of said locking pin extends away from said shaft wherein said rounded end of said locking pin slidably engages said pin groove;

a primary washer coupled to said bottom edge of said upper portion of said tubular member wherein said shaft extends through said primary washer, said shaft being positionable in a locking position wherein said shaft is urged downwardly such that said rounded end of said locking pin travels downwardly in said pin groove until said rounded end of said locking pin abuts a top of said primary washer, said shaft being rotated such that said rounded end of said locking pin travels laterally along said rotation slot until said rounded end of said locking pin abuts said second end of said rotation slot, said shaft being lifted upwardly wherein said rounded end of said locking pin travels upwardly in said transition groove until said rounded end of said locking pin is positioned in said first end of said locking slot, said shaft being further rotated such that said rounded end of said locking pin travels laterally along said locking slot until said rounded end of said locking pin abuts a second end of said locking slot wherein said shaft is retained in said locking position;

a handle coupled to said shaft proximate said top end of said shaft wherein said handle is configured to be gripped by a user;

a locking bracket slot extending through a front side and a back side of said handle;

a locking bracket including a centrally positioned bend on said locking bracket wherein a mounting portion of said locking bracket forms a right angle with respect to a lock portion of said locking bracket, said mounting portion of said locking bracket being coupled to the front side of the door proximate said top end of said shaft wherein said lock portion of said locking bracket is directed forwardly from the front side of the door, said handle engaging said locking bracket when said shaft is moved into said locking position wherein said lock portion of said locking bracket extends through said locking bracket slot;

a lock aperture extending through a top side and a bottom side of said lock portion of said locking bracket;

a secondary washer coupled to said shaft proximate a middle of said shaft;

a biasing member positioned within an interior of said tubular housing wherein said shaft extends through said biasing member, said biasing member urging said shaft upwardly between a locking position and an unlocked position; and a shaft cup extending into downwardly a support surface wherein said shaft cup is positioned proximate a bottom of the door when the door is in a closed position, said shaft cup insertably receiving said bottom end of said shaft when said shaft is positioned in said locking position wherein the door is locked in the closed position.

* * * * *